US007982401B2

(12) United States Patent
Luttio

(10) Patent No.: US 7,982,401 B2
(45) Date of Patent: Jul. 19, 2011

(54) XENON LAMPS

(75) Inventor: Kenneth L. Luttio, Glendora, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 226 days.

(21) Appl. No.: 12/349,865

(22) Filed: Jan. 7, 2009

(65) Prior Publication Data

US 2009/0218947 A1 Sep. 3, 2009

Related U.S. Application Data

(63) Continuation of application No. 11/202,980, filed on Aug. 12, 2005, now Pat. No. 7,489,082.

(60) Provisional application No. 60/600,861, filed on Aug. 12, 2004, provisional application No. 60/602,922, filed on Aug. 19, 2004.

(51) Int. Cl.
*H01J 61/33* (2006.01)

(52) U.S. Cl. ..... 313/634; 313/331; 313/491; 313/573

(58) Field of Classification Search ..... 313/634, 313/635, 573, 493
See application file for complete search history.

(56) References Cited

U.S. PATENT DOCUMENTS

2005/0168148 A1 * 8/2005 Allen et al. ..... 313/634
* cited by examiner

*Primary Examiner* — Joseph L Williams

(57) ABSTRACT

A xenon short arc lamp which has a middle section with a length to diameter ratio greater than 1.6 and which is directly interchangeable with a xenon short arc lamp of the same wattage in a lamphouse without modifying the lamphouse.

8 Claims, 5 Drawing Sheets

XENON LAMPS

RELATED APPLICATIONS

This application is a continuation of U.S. patent application Ser. No. 11/202,980 filed on Aug. 12, 2005, now U.S. Pat. No. 7,489,082, which claims priority to U.S. Provisional Application Ser. No. 60/600,861 filed Aug. 12, 2004 and to U.S. Provisional Application Ser. No. 60/602,922 filed Aug. 19, 2004, and the disclosures thereof are incorporated herein by this reference.

FIELD OF THE INVENTION

This invention relates to more light from xenon short arc lamps; and, more particularly, to lamps having a more elliptical envelope and to the use of such lamps.

BACKGROUND OF THE INVENTION

Xenon lamps of interest herein are short arc or compact arc lamps having an arc gap between the cathode and anode electrodes of less than 14 mm. These lamps are useful where a high intensity point source is needed. Typical examples of such use are in searchlights, solar simulators, medical instrumentation, photoresist exposure and video and film display projectors.

A xenon short arc lamp is filled with a xenon gas or another noble gas or mixture which will produce an essentially continuous spectrum of visible light. Short arc lamps have many uses and, without limiting these uses, the particular area of use described herein will be in lamphouses for cinema projection.

These lamphouses include, among other elements, a reflector/collector for collecting the optical radiation from a lamp, adjustable mounts for the lamp to focus the system so that the light goes through the aperture, an aperture through which the collected light is reflected, a lens beyond the aperture for collecting and focusing the light, and a power supply for operation of the lamp and lamphouse.

Some commonly used lamphouses for cinema projection are manufactured by Strong-Cinema Products, a division of Ballantyne of Omaha, Inc. and having an internet address of www.strong-cinema.com. Lamphouses are made for xenon short arc lamps having an output of 700 watts up to 10,000 watts and are designed to accept standard xenon short arc lamps.

There are various manufacturers of xenon short arc lamps, including, Osram, Ushio, Superior Quartz and Lighting Technology International (the Assignee of this application). These manufacturers, following what has become industry standards, manufacture various models of xenon short arc lamps. These models are categorized by wattage and mounting technique. Xenon short arc lamps for cinema projection lamphouses range from 500 watts to 10,000 watts and are typically mounted in a horizontal position in the lamphouse.

The lamps that have been manufactured in the past have an industry standard configuration and dimensions that fit within a useful range. In particular, the envelope of these lamps consists of a quartz glass housing having two cylindrical sections and a nearly spherical middle section. A useful and distinguishing measurement of the middle section is the ratio of the length (L) of the middle section to the diameter (D) of the middle section.

The length (L) is measured from the point of transition from the straight surface of a cylindrical section to the curved surface of the middle section at one end of the middle section to the transition at the other end of the middle section. The ratio of length (L) to diameter (D) of xenon short arc lamps for cinema projector lamphouses have not exceeded 1.45 as far as the inventor herein knows.

There is one exception to the upper ratio and that is for a lamp manufactured by Osram that is called a gap shortened (GS) lamp. The ratio of length to diameter for Osram's XBO 4200 W/GS lamp is approximately 1.871. This lamp has been used in specially modified lamphouses with attendant additional expense. In particular, the lamp has been advertised, since at least August 2002, for use with a revolutionary lamphouse conversion that replaces and repositions the reflector and replaces the xenon lamp. This has been stated by NCS Corporation of 14499 North Dale Mabry Highway, Suite 201, Tampa, Fla. in its TechnaLight high definition film presentation. The conversion involves replacing the old reflector with a new reflector in a different position and replacing the lamp holder.

Strong-Cinema Products of Strong International also put lamps having a length in diameter ratio greater than 1.6 in a lamphouse with a different reflector. This is set forth in the Strong-Cinema advertisements entitled Application Guide Number: AG-002 dated Aug. 12, 2003. Strong International has an office at 4350 McKinley Street, Omaha, Nebr.

SUMMARY OF THE INVENTION

It has been found that xenon short arc lamps having a length (L) to diameter (D) ratio of greater than 1.6 and the same arc gap as lamps with an L to D ratio less than 1.45 provide more light out by as much as 30% or more, compared to these lamps with an L to D ratio of less than 1.45.

These lamps with a ratio greater than 1.6 have a more elliptical envelope than the lamps with a ratio of less than 1.45. Further, these lamps are useful in many of the same applications. These lamps are directly interchangeable with the lamps having a ratio of less than 1.45. This is especially important in lamphouses since lamps having a shortened gap (GS) and a ratio greater than 1.6 have required that the lamphouse be modified or converted.

These lamps are energy efficient and save money. A smaller wattage lamp provides the same output as a higher wattage lamp having a ratio less than 1.45.

These and other features, aspects and advantages of the present invention will be more fully understood from a consideration of the above, the following detailed description, the appended claims and the accompanying drawings.

DESCRIPTION OF THE PREFERRED EMBODIMENT

The orientation of the lamps and lamphouse is based on the front of a lamphouse being the end where the light is emitted. Consequently, each view of FIGS. 1 through 5 is a left side elevation with the housing of the lamphouse in cross-section.

Figure 1:
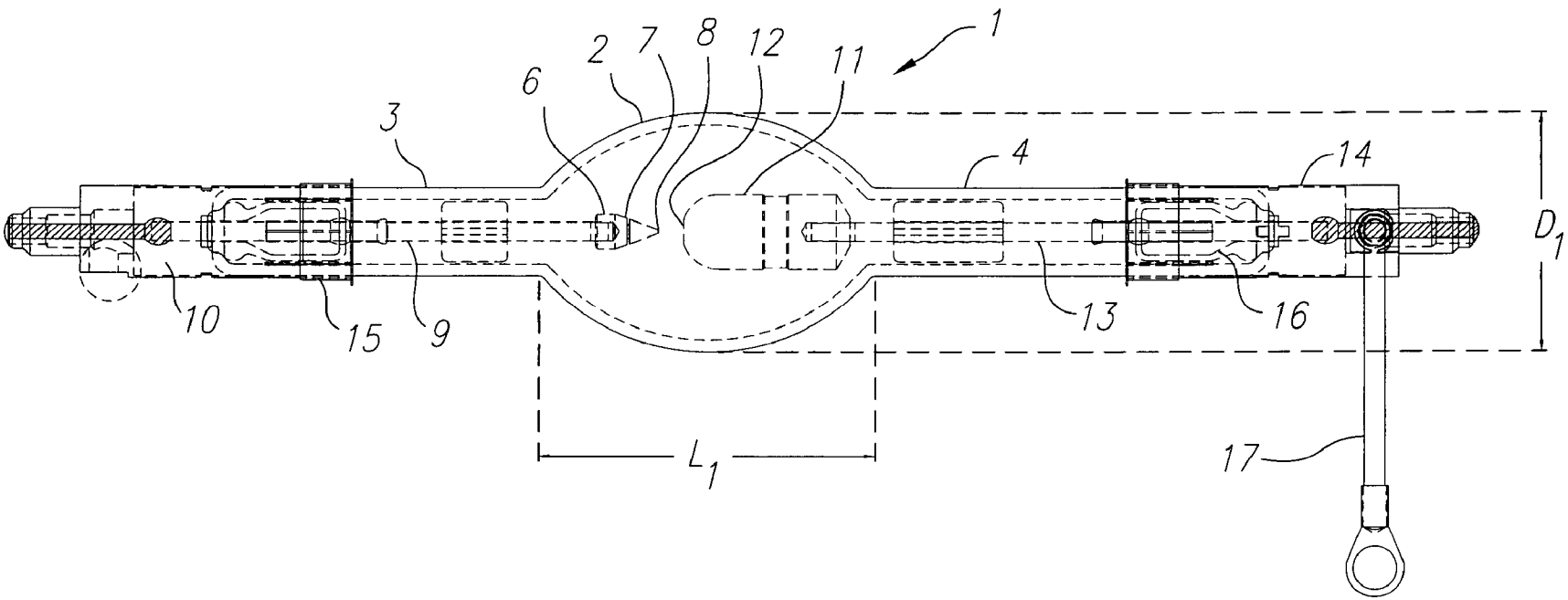
FIG. 1 is a left side elevation view of a prior art xenon short arc lamp having an L to D ratio of less than 1.45.

A xenon short arc lamp 1 having a length ($L_1$) to diameter ($D_1$) ratio of less than 1.45 is shown in FIG. 1. The lamp 1 has the typical dimensions for a 4200 watt rated xenon short arc lamp, which are:

| | |
|---|---|
| Overall length: | 16.70 |
| Length of middle section 2: | 3.674 |
| Outside diameter of middle section 2: | 2.756 |
| Ratio: | 1.333" |
| Length of cylindrical section 3 | 5.6825" |
| Outside diameter of cylindrical section 3 | 1.063" |
| Length of cylindrical section 4: | 5.6825" |
| Outside diameter of cylindrical section 4 | 1.063' |
| Arc cap | 0.280" |

Lamp 1 has a middle section 2, a first cylindrical section 3 and a second cylindrical section 4. The length $L_1$ is measured between the point of transition between the straight surface of section 3 to the curved surface of middle section 2 and the point of transition from the straight surface of section 4 to the curved surface of middle section 2. The length $L_1$ for lamp 1 of FIG. 1 is 3.674 inches.

The diameter $D_1$ is measured about the greatest diameter of the middle section 2, which is at the center of the section, as shown in FIG. 1. The diameter $D_1$ of lamp 1 of FIG. 1 is 2.756 inches. Consequently, the length (L) to diameter (D) ratio of lamp 1 is 1.3333; and, therefore, less than 1.45.

The middle section 2, first cylindrical section 3 and second cylindrical section 4 are a unitary body of blown quartz glass that form the housing or envelope for the xenon short arc lamp 1.

The lamp 1 has a cathode 6 with a pointed end 7 terminating at the cathode tip 8. The lamp 1 further includes a tungsten shaft 9 that extends from the cathode 6 to an electrical connector outside the lamp housing. The cylindrical section 3 at the cathode end of lamp 1 terminates in a metallic ferrule or cathode base 10.

The second electrode of lamp 1 is the anode 11. Anode 11 has a face 12 that is opposite the cathode 6. The distance between the tip 8 of cathode 6 and the face 12 of anode II is the arc gap of the lamp 1. As shown in the drawing this distance is nominally 0.280 inches.

The anode 11 has a tungsten shaft 13 that couples the anode to an electrical connector outside the housing. The end of shaft 13 is attached to an anode ferrule or base 14. Ferrule 14 provides an electrical path from anode 11 to a power source (not shown).

Lamp 1 has a hermetic seal at each end to contain the gas. There are many types of seals, but the seal shown in FIGS. 1 and 2 is a graded seal.

The cathode end of a xenon short arc lamp, such as lamp 1, is generally rigidly attached. For this purpose, a means for attaching the cathode end is provided. The cathode mount has a configuration that mates with the end of the lamp to secure it in place. For example, the cathode mount has a hole for receiving a shaft protruding from the cathode end. Alternatively, the hole and shaft may be threaded. In any event, the cathode end is rigidly mounted. In lamphouses and other similar uses, the cathode mount is adjustable in the x, y and z directions for focusing the system, by properly positioning the lamp with respect to the reflector.

The anode end of the lamp is typically left loose to provide for thermal expansion and contraction of the lamp. As shown in FIG. 1, an electrical connecting cable 17 is attached to the metallic ferrule 14 or an extension from this ferrule to provide a connection to a source of power.

Figure 2:
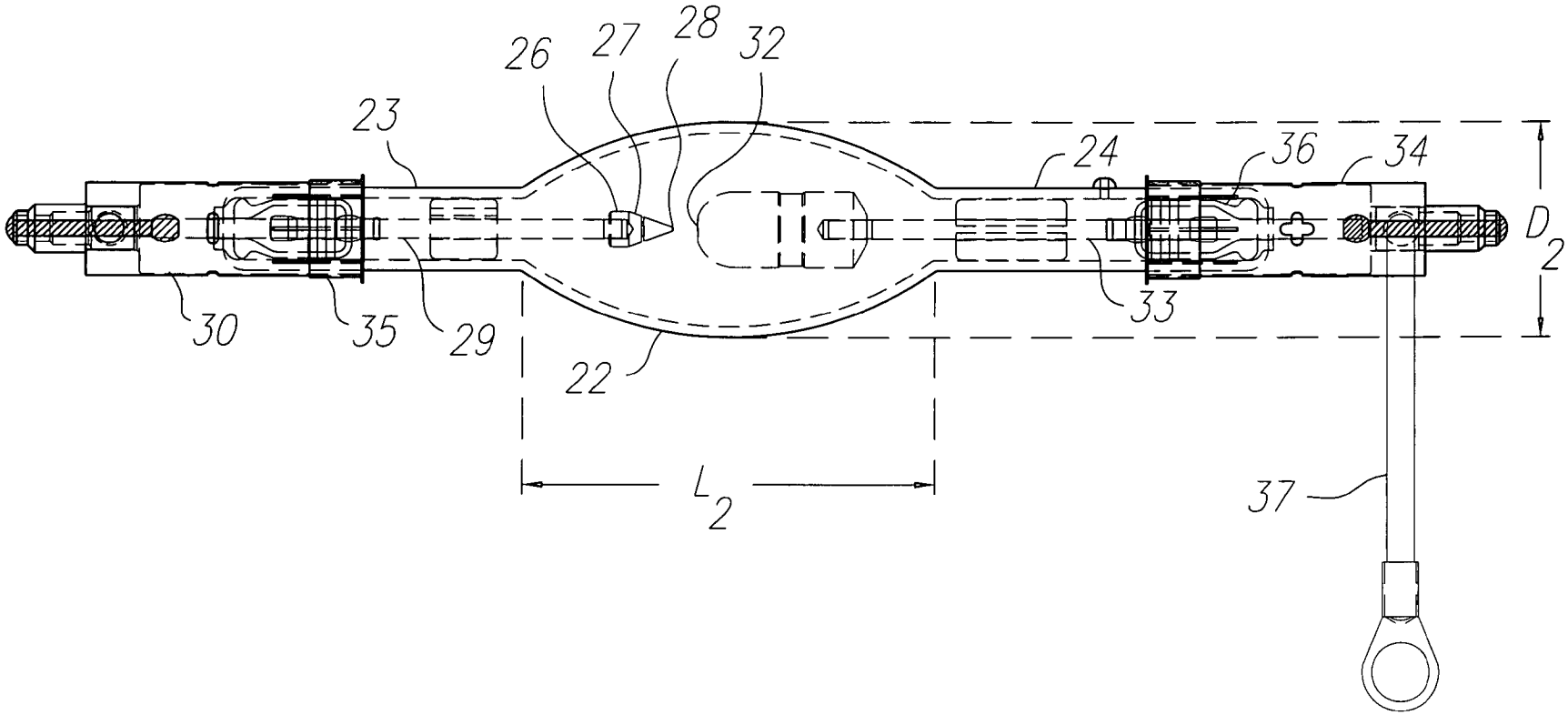
FIG. 2 is a left side elevation view of a xenon short arc lamp having an L to D ratio greater than 1.6.

A 4200 watt rated xenon short arc lamp 20 having a length $L_2$ to diameter $D_2$ ratio greater than 1.6 is shown in FIG. 2. This lamp 20 has an arc gap of 0.280 inches, the same as lamp 1 of FIG. 1. Further, the overall length and the distance from the tip of the cathode to the outer surface of the cathode ferrule are the same. The dimensions for lamp 20 are:

| | |
|---|---|
| Overall length: | 16.70" |
| Length of middle section 2: | 4.532" |
| Outside diameter of middle section 2: | 2.441" |
| Ratio: | 1.86" |
| Length of cylindrical section 3 | 5.6825" |
| Outside diameter of cylindrical section 3 | 1.063" |
| Length of cylindrical section 4: | 5.6825" |
| Outside diameter of cylindrical section 4 | 1.063" |
| Arc csp | 0.280" |

Lamp 20 has the same elements as lamp 1 of FIG. 1 except for a different shaped housing or envelope of quartz glass. The elements of lamp 20 have a number designation that is 20 greater than the reference number for the same element of lamp 1; for example, the cathode of lamp 20 has the reference number 26 while cathode 6 of lamp 1 has the reference number 6.

Lamp 20 of FIG. 2 has a light output that is at least 30% greater than the light output of lamp 1 of FIG. 1. The middle section 22 of this lamp 20 has a length $L_2$ of 4.532 inches and a diameter $D_2$ of 2.441 inches for a ratio of 1.86, which is greater than 1.6. Lamp 20 is interchangeable with lamp 1 in a lamphouse without modifying the lamphouse and produces the increased light output.

Figure 3:
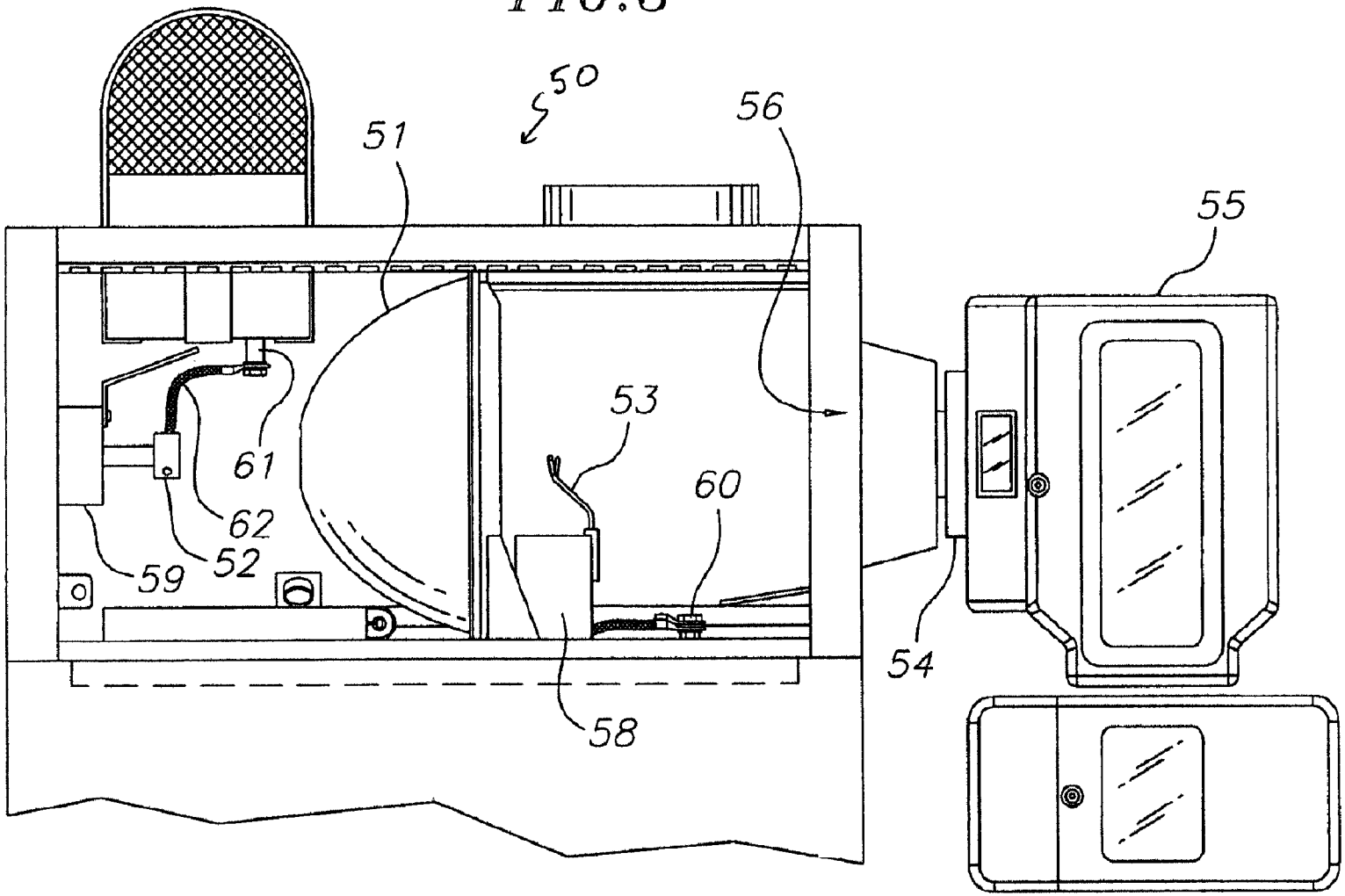
FIG. 3 is a left side elevation view of a lamphouse, with the side door open, and a film shutter and transport.

The elements of concern in a lamphouse are shown schematically in FIG. 3. A lamphouse 50 includes an elliptical collector/reflector (hereinafter called a "reflector") 51, an adjustable cathode mount 52, a wishbone shaped anode end holder 53 or some similar support and a lens 54. The lamphouse is coupled to a shutter and film transport 55, shown in block form in FIG. 3.

The lamphouse 50 further includes an aperture 56 through which the collected and reflected light is focused.

The anode end holder 53 is attached to and supported by an electrically insulated mount 58. Similarly, the adjustable cathode mount 52, the x, y, z focusing devise, is attached to and supported by an electrically insulated mount 59. A terminal post 60 is provided for electrically attaching the cable 17 or cable 37 or similar anode cable to a source of power (not shown). A terminal post 61 is connected through a cable 62 to the cathode mount to provide an electrical connection between the cathode of the lamp and the source of power.

Figure 4:
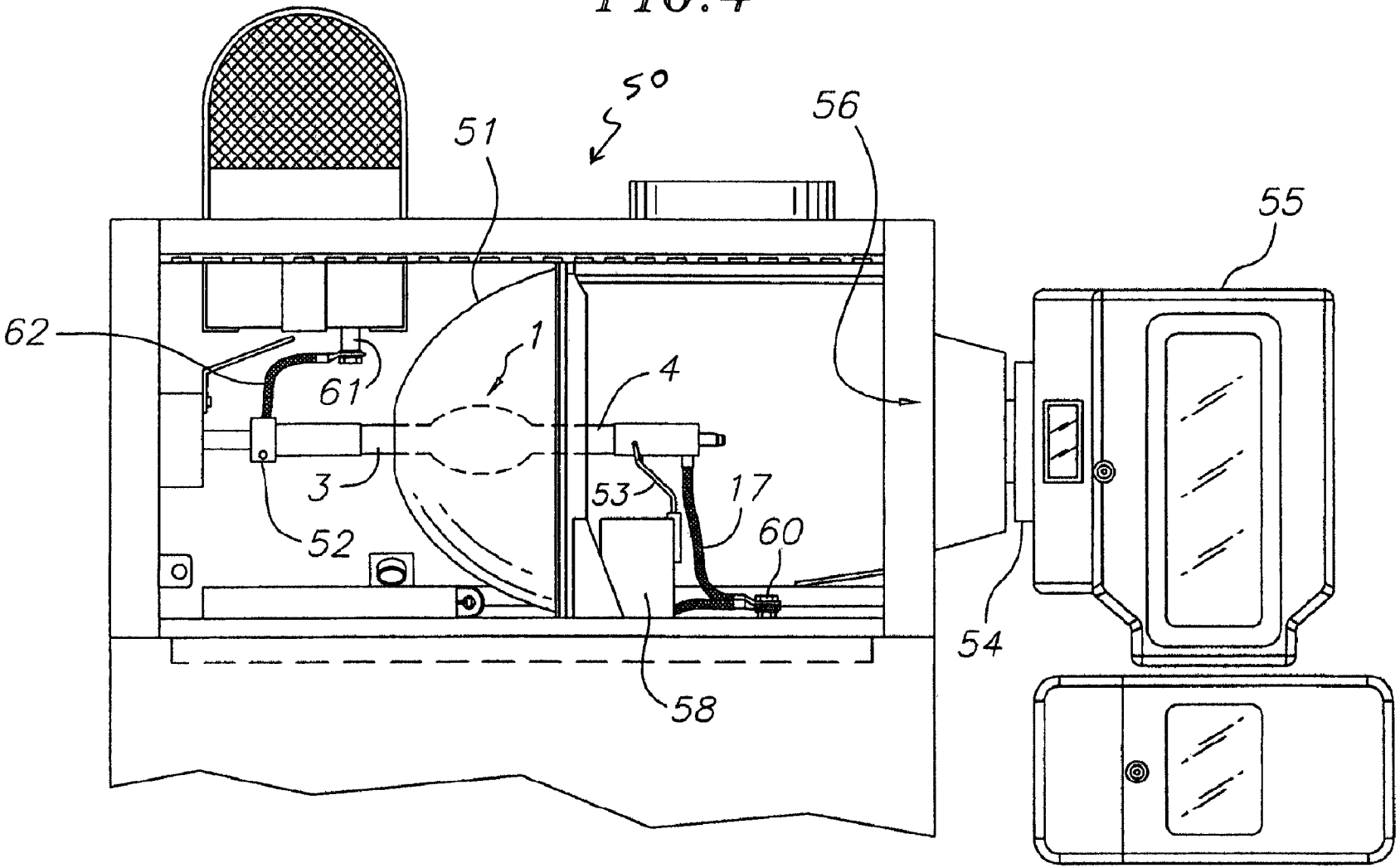
FIG. 4 is a left side elevation view of the lamp-house with the outside housing in cross-section down the middle and with the other components of the lamphouse in elevation and with the lamp of FIG. 1, shown in elevation, in place in the lamphouse.
Figure 5:
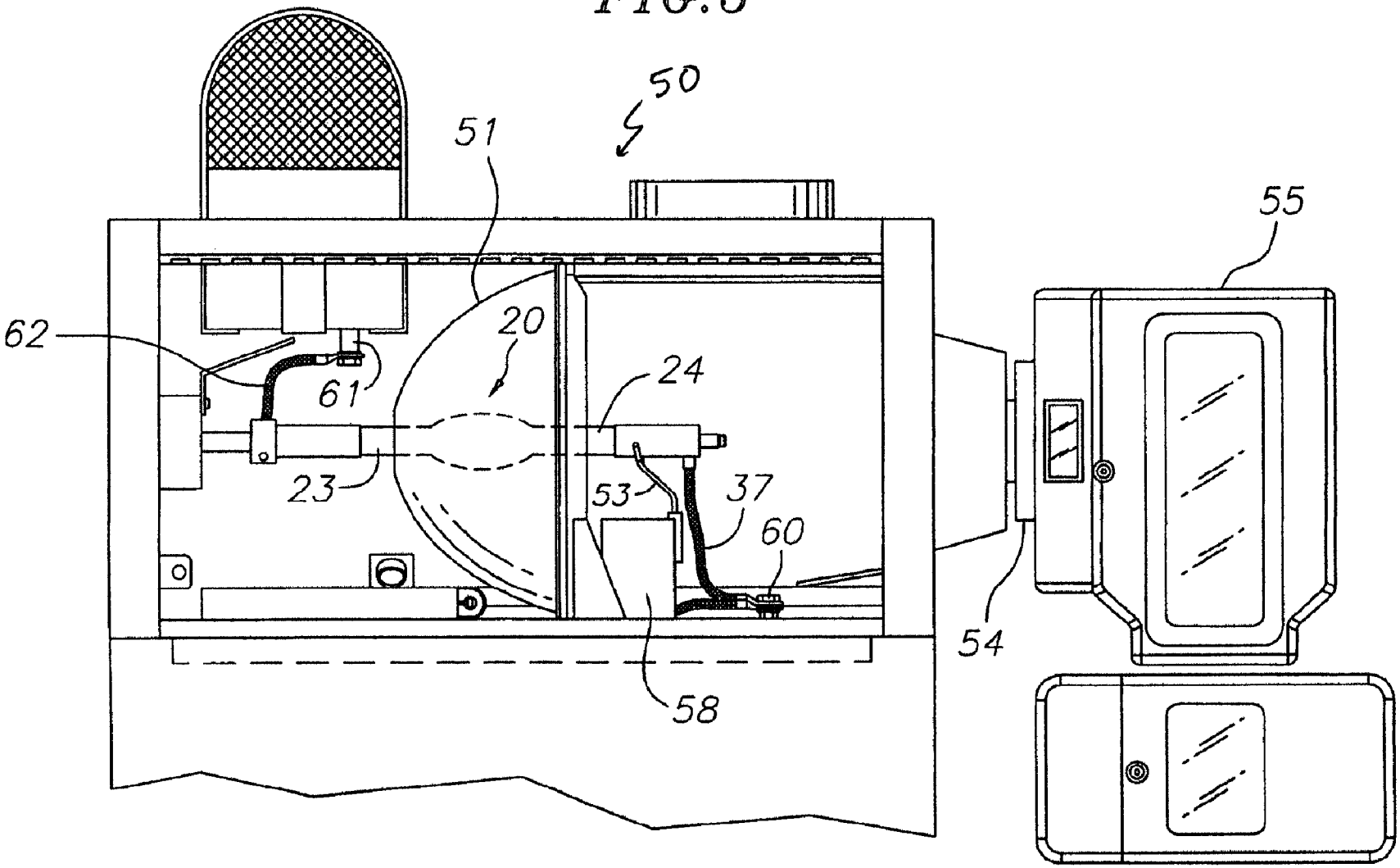
FIG. 5 is a left side elevation view of the lamp-house with the outside housing in cross-section down the middle and with the other components of the lamphouse in elevation and with the interchangeable lamp of FIG. 2, shown in elevation, in place in the lamphouse.

The Lamphouse 50 of FIG. 3 is shown in FIG. 4 with the lamp 1 of FIG. 1 in place. The lamphouse 50 of FIG. 3 is shown in FIG. 5 with the lamp 20 of FIG. 2 in place.

In the past xenon short arc lamps with a length to diameter ratio greater than 1.6 have been used. However, these lamps also included a shorter arc gap or gap shortened configuration and were used only after modifying the lamphouse. There was no direct interchanging of a lamp with an L to D ratio greater than 1.6 for a lamp with an L to D ratio less than 1.45.

The arc gap is not changed in the lamps of this invention where the L to D ratio is greater than 1.6. Further, in use, the lamphouse does not have to have a conversion that adds expense to the system, to use the lamps that have an L to D ratio great than 1.6.

It should be noted that the lamps in the drawings are shown in the horizontal position. These lamps of this type can also be used in a vertical position.

The invention is not limited to the particular embodiment or arrangement disclosed, but is rather intended to cover any changes, adaptation or modification which are within the scope and spirit of the invention as defined by the appended claims.

What is claimed is:

1. A short arc lamp comprising an envelope having a middle section with a length to diameter ratio of greater than 1.6, a cathode having a tip, a cathode ferrule having an outer surface, wherein a distance from the tip of the cathode to the outer surface of the cathode ferrule is same as that of a short arc lamp with an envelope having a middle section with a length to diameter ratio of less than 1.45.

2. The short arc lamp of claim 1, further comprising an anode, wherein the cathode and the anode are spaced apart with an arc gap of 0.28 inch.

3. The short arc lamp of claim 1, wherein an overall length of the short arc lamp is 16.7 inches.

4. The short arc lamp of claim 1, wherein the short arc lamp is used for a video display projector.

5. A short arc lamp comprising an envelope having a middle section with a length to diameter ratio of greater than 1.6, wherein an overall length of the short arc lamp is same as that of a further short arc lamp with a length to diameter ratio of less than 1.45.

6. The short arc lamp of claim 5 wherein the overall length of the short arc lamp and of the further short arc lamp is 16.7 inches.

7. The short arc lamp of claim 5 wherein the short arc lamp is used for a video display projector.

8. The short arc lamp of claim 5, further comprising a cathode and an anode, wherein the cathode and the anode are spaced apart with an arc gap of 0.28 inch.

* * * * *